US007918700B1

(12) United States Patent
Potthast

(10) Patent No.: US 7,918,700 B1
(45) Date of Patent: Apr. 5, 2011

(54) WATER AND ICE RESCUE DEVICE AND METHOD OF PERFORMING A RESCUE UTILIZING THE DEVICE

(76) Inventor: William K. Potthast, Columbia, SC (US)

( * ) Notice: Subject to any disclaimer, the term of this patent is extended or adjusted under 35 U.S.C. 154(b) by 0 days.

(21) Appl. No.: 12/258,722

(22) Filed: Oct. 27, 2008

Related U.S. Application Data

(60) Provisional application No. 60/982,546, filed on Oct. 25, 2007.

(51) Int. Cl.
*B63C 9/00* (2006.01)

(52) U.S. Cl. ..... 441/80; 441/6

(58) Field of Classification Search ..... 441/6, 30, 441/80, 1, 7, 13, 20, 21
See application file for complete search history.

(56) References Cited

U.S. PATENT DOCUMENTS 1,727,902 A * 9/1929 Reno ..... 441/80
3,828,380 A * 8/1974 Lebovits et al. ..... 441/21
3,863,591 A * 2/1975 Wild ..... 114/230.26
3,877,096 A * 4/1975 Scesney ..... 441/6
4,014,057 A * 3/1977 Kuojarvi ..... 441/80
5,441,006 A * 8/1995 Wood ..... 441/80
7,083,483 B2 * 8/2006 Corlett ..... 441/6
7,364,486 B2 * 4/2008 Serpa ..... 441/80

* cited by examiner

*Primary Examiner* — Lars A Olson
(74) *Attorney, Agent, or Firm* — Marshall & Melhorn, LLC

(57) ABSTRACT

A rescue apparatus comprises a plurality of elongate, buoyant, rigid members attached at their respective ends to one another at a selected one of a plurality of possible angles relative to one another and in a manner to prevent relative movement between the attached members. Any number of the members can be affixed together to form one linear section, to form a length with a zig-zag configuration, to form an L-shaped length of members to extend around a corner, to form a hook or loop shape at the end of a straight length, or virtually any other configuration which might be advantageous in a particular water or ice rescue situation. At least a portion of the rescue device is extended to a position within reach of the victim to affect the rescue. In a preferred embodiment, three of the members have been attached together to form a triangular rescue device that can be thrown or launched near the victim for use as a floatation device.

14 Claims, 4 Drawing Sheets

WATER AND ICE RESCUE DEVICE AND METHOD OF PERFORMING A RESCUE UTILIZING THE DEVICE

RELATED APPLICATION

This application is claiming the benefit, under 35 U.S.C. §119(e), of the provisional application filed Oct. 25, 2007 under 35 U.S.C. §111(b), which was granted Ser. No. 60/982,546. This provisional application is hereby incorporated by reference in its entirety.

BACKGROUND OF THE INVENTION

The invention relates to rescue devices and methods, and more particularly to a device and method of rescuing a victim from a body of water, particularly a victim that has fallen through a layer of ice.

It is well known to utilize ring buoys in the rescue of a victim from a body of water. Such ring buoys, as a rule, utilize plastic having a substantial degree of mechanical strength and requiring a plastic density of the general order of at least about six pounds per cubic foot of plastic. Such plastic buoys are molded to the desired toroidal shape, usually a flattened toroid, and come in various sizes. Suitable ropes are attached to such prior art ring bodies by anchoring the same with bands of fabric or sheet plastic encircling an arcuate portion of the ring completely around a toroid portion.

More complex devices are known to aid in the rescue of victims that have fallen through a layer of ice. For instance, U.S. Pat. No. 6,190,222 describes a rescue ramp having a dual lobed, hinged inflatable ramp having two pairs of spaced inflatable tubes and a flexible floor mounted between each and connecting the tubes. A rope ladder is mounted to the floors of the lobes. The coiled ramp must be positioned on shore near the water's edge and pointed toward the victim. The ramp tubes are then inflated, extending the rescue ramp with web or floor out and toward the victim, to its extended length. Once the extended ramp is pointed more closely to the victim and anchor lines are secured, a rescuer may travel the floor out to the victim.

Thus, there is a need for an improved device and method of rescuing a victim in a body of water, especially a victim that has fallen through a thin layer of ice. The rescue of such a victim using current methods typically requires excessive time to implement, overly complex equipment, and/or unnecessary risks to the rescuers.

BRIEF DESCRIPTION OF THE DRAWINGS

The invention provides a method of rescue that may be implemented quickly using the relatively simple and readily adaptable device of the invention, and without risk to those performing the rescue. The advantages of the invention will become readily apparent to those skilled in the art from the following detailed description of a preferred embodiment when considered in the light of the accompanying drawings, in which.

DETAILED DESCRIPTION OF THE INVENTION

It is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions, directions or other physical characteristics relating to the embodiments disclosed are not to be considered as limiting, unless the claims expressly state otherwise.

Figure 1:
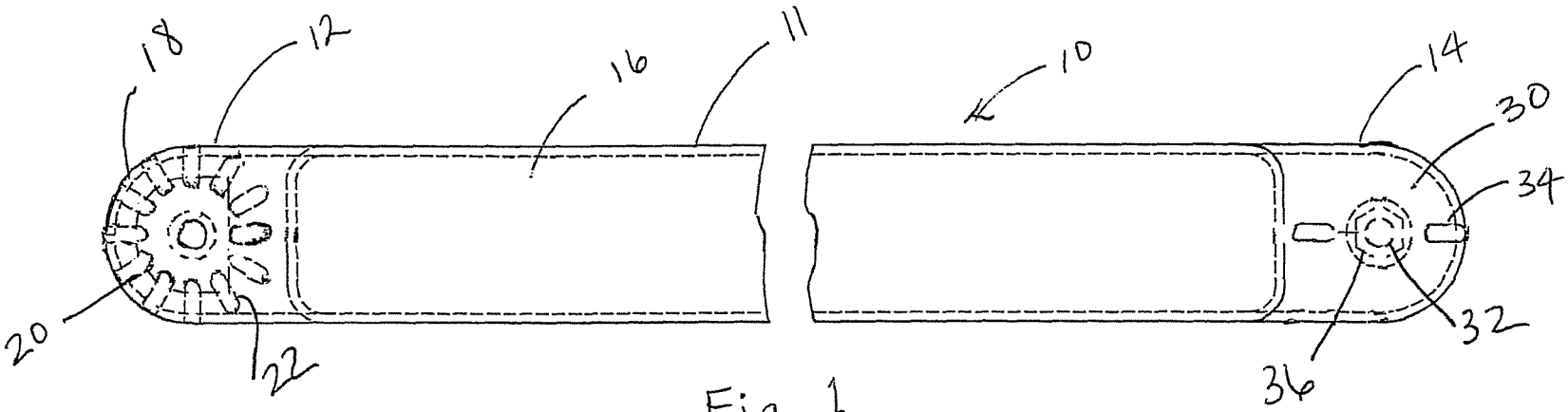
FIG. 1 is a side view of one of the elongate, floating members in accordance with the invention.
Figure 6:
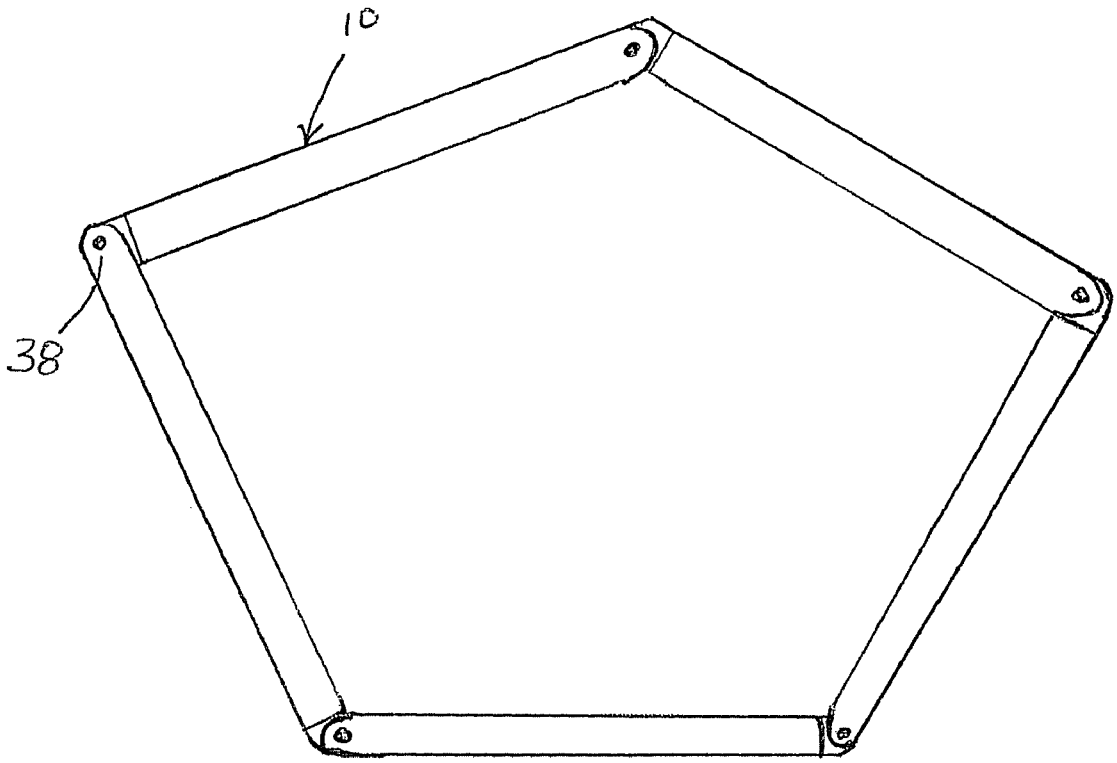
FIG. 6 is top view of five of the members shown in FIG. 1 attached together to form a pentagonal rescue device.
Figure 7:
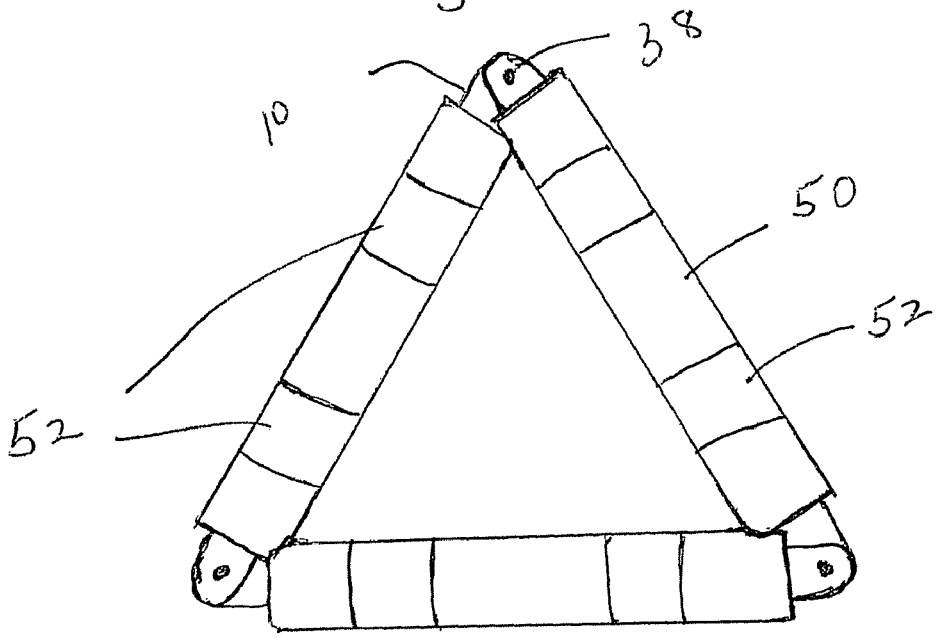
FIG. 7 is top view of three of the members shown in FIG. 1 attached together to form a triangular rescue device.

Referring now to FIG. 1 of the drawings, one of the elongate, buoyant members 10 of the invention is illustrated having a main body 11, a first end 12, and a second end 14. In use in accordance with the method of the invention, two or more of the elongate, buoyant members 10 are connected together as described below and as shown, as examples, in FIGS. 6-8.

The main body 11 of the member 10 is formed such that the member 10 is buoyant and yet rigid. Thus, the main body 11 may be formed of a solid material that is less dense than water, including a foamed material. Preferably, the main body 11 is formed of a hollow tube or pipe that defines a sealed inner space 16. Such a hollow tube may preferably be formed of a lightweight, but sufficient strong and rigid plastic material, and is most preferably formed of polyvinyl chloride pipe. Typically, such polyvinyl chloride pipe would have a diameter in the range of 2-4 inches to balance the weight of the member 10 against its buoyancy, strength and rigidity, but the use of other materials and sizes are well within the scope of the invention. The device as a whole should be sufficiently buoyant that it is able to support the weight of a victim at the surface of the water.

The first end 12 of a first member 10 is provided with a mechanical means for selectively attaching to a complementary mechanical means on the second end 14 of a second member 10, the first and second members 10 being essentially identical. Likewise, the first end 12 of the second member 10 is provided with a mechanical means for selectively attaching to a complementary mechanical means on the second end 14 of a third member 10, the second and third members 10 being essentially identical. The mechanical means are preferably such that adjacent members 10 can be affixed together at a selected one of a plurality of different fixed angles with respect to one another, preferably allowing attachment at angles ranging from 180° to less than 90°, and in such a manner that the members lie in the same plane.

Figure 2:
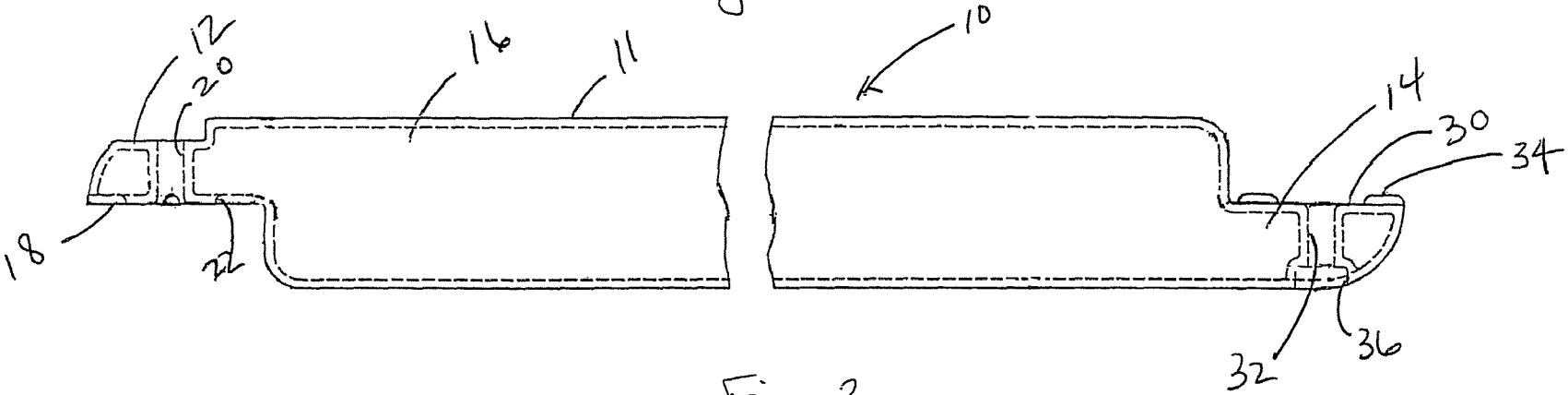
FIG. 2 is a top view of the member shown in FIG. 1.
Figure 3:
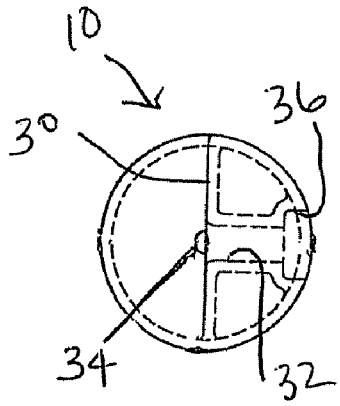
FIG. 3 is an end view of the member shown in FIG. 1.

In the illustrated embodiment, the first end 12 of each member 10 is provided with a stepped portion 18, best seen in FIG. 2, having a surface facing transversely to the longitudinal axis of the main body 11. On this surface are provided a centrally located hole 20 for receiving a fastener and a plurality of spaced apart indentations 22 that extend radially from the hole 20.

The second end 14 of each member 10 is provided with a stepped portion 30, again best seen in FIG. 2, having a surface facing transversely to the longitudinal axis of the main body 11 and being adapted to mate with the stepped portion 18 on the first end of an adjacent member 10. On this surface of the second end 14 are provided a centrally located hole 32 for receiving the fastener and a plurality of spaced apart projections 34 that extend radially from the hole 20. As illustrated, the second end 14 is provided with a pair of radially aligned projections 34, one on either side of the hole 32.

Figure 5:
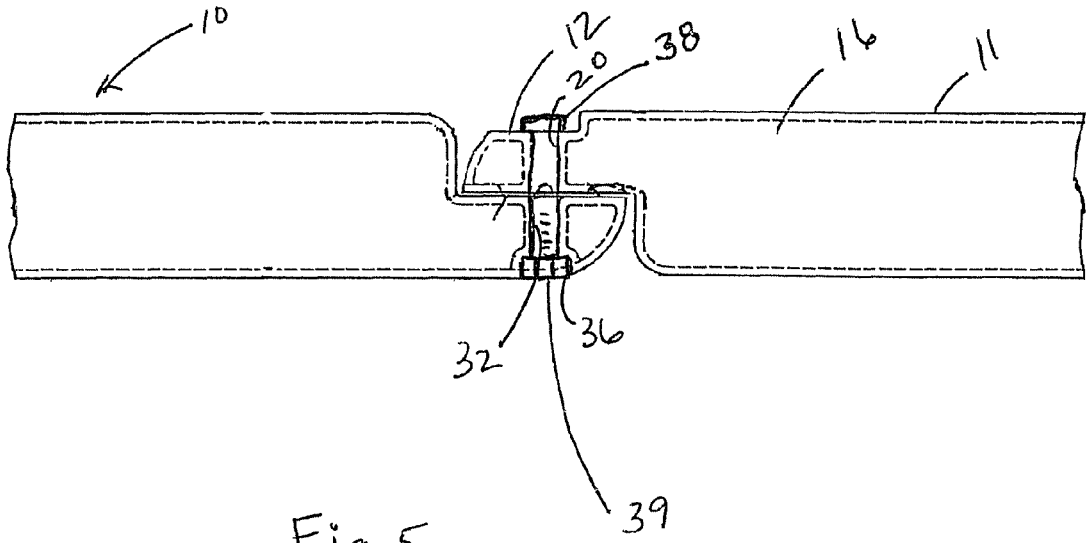
FIG. 5 is a side view of two of the members shown in FIG. 1 attached together.

Thus, when the stepped portion 18 of a first member 10 is mated with the stepped portion 32 of a second member 10, the projections 34 are received within a selected, radially aligned pair of the indentations 22, to position the two members at the selected angle one to the other. Of course, the indentations could be provided on the second end 14 while the projections are formed on the first end 12. The members may then be held in the selected position by a suitable fastening means, such by a threaded fastener 38 received in the aligned holes 20 and 32, preferably with a nut 39 held in a recess 36 of a complementary shape to prevent relative rotation of the nut 39, as illustrated in FIG. 5. The invention is, however, not limited to this type of fastener, and any fastener that is capable of rigidly and securely fixing adjacent members together, preferably in the quickest manner possible, may be utilized.

Figure 4:
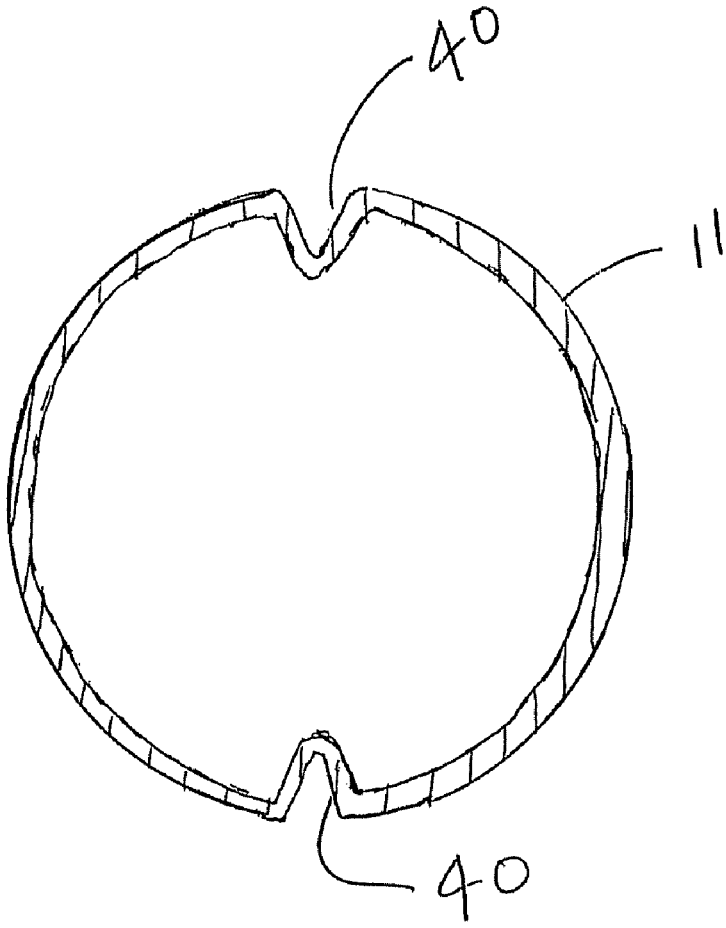
FIG. 4 is a cross-section sectional view of an alternate embodiment of one of the elongate, floating members of the invention.

In the alternate, preferred embodiment shown in FIG. 4, the main body 11 of each member 10 is provided with one or more rigidity-enhancing structures, such as the preferred "V" shaped grooves 40, which alter the otherwise circular cross section of the main body 11. There are preferably at least two grooves 40 positioned radially opposite one another and extending substantially the entire length of the main body 11. The grooves 40 help to increase the rigidity of the members 10 during use.

In a rescue situation, two or more of the members 10 can be quickly assembled and secured together in the desired configuration as described above, with relative movement between adjacent members 10 that have been secured together prevented. As examples, any number of the members 10 can be affixed together to form one linear section, to form a length with a zig-zag configuration, to form an L-shaped length of members to extend around a corner, to form a hook or loop shape at the end of a straight length, or virtually any other configuration which might be advantageous in a particular water or ice rescue situation.

Once the device has been assembled in the desired configuration, it may be extended out over the ice or water to the victim, leaving the rescuers in relative safety. Once the victim grabs hold of a portion of the buoyant device, or once a portion of the device has been hooked about the victim, the rescuers may use the device to move the victim to safety. The device can also be utilized by a rescuer to grab hold of and pull himself across the ice or surface of the water to the victim safely and quickly.

Moreover, as an initial measure, a section of two or more members 10 assembled together could be thrown or launched near the victim for use as a floatation device until a rescue device can be assembled that is long enough to reach from the rescuers' position to the victim for retrieval of the victim. Preferably, such a floatation device is formed by three or more of the members 10 secured end-to-end to one another. Thus, in the embodiment illustrated in FIG. 6, five of the members 10 have been attached together to form a pentagon, while in the especially preferred embodiment illustrated in FIG. 7, three of the members have been attached together to form a triangle.

Additionally, other devices, such as a life preserver, large inner tube, a light, etc., could be secured to an end of the assembled device, which then can be transported out to the victim. Further, one or more of the members 10 utilized in a rescue device may be provided with a sleeve 50 of a buoyant material, preferably a foam material that fits snugly about at least a portion of the length of the main body 11 of the member(s) 10, to enhance the overall buoyancy of the rescue device. It may also be advantageous to provide one or more of the members 10 with one or more light reflective portions, such as the light reflective tape 52 applied about the sleeves 50 in FIG. 7.

In accordance with the provisions of the patent statutes, the invention has been described in what is considered to represent its preferred embodiments. However, it should be noted that the invention can be practiced otherwise than as specifically illustrated and described without departing from its spirit or scope.

What is claimed is:

1. A rescue apparatus comprising a plurality of elongate, buoyant, rigid members attached at their respective ends to one another at a selected one of a plurality of possible angles relative to one another and in a manner to prevent relative movement between the attached members, wherein a first end of a first elongate, buoyant, rigid member comprises a stepped portion defining a surface facing transversely to a longitudinal axis of the first member, and a second end of a second elongate, buoyant, rigid member comprises a stepped portion defining a surface facing transversely to the longitudinal axis of the second member, the first end of the first member having a complementary configuration to and abutting the second end of the second member.

2. The rescue apparatus of claim 1, further comprising a sleeve of foamed material fitted over one or more of the members.

3. The rescue apparatus of claim 1, wherein the members are hollow.

4. The rescue apparatus of claim 1, further comprising three elongate, buoyant, rigid members rigidly attached at their respective ends to one another to form a triangle.

5. The rescue apparatus of claim 1, wherein each of the members is provided with one or more rigidity-enhancing grooves extending along length thereof.

6. The rescue apparatus of claim 5, wherein the grooves are V-shaped in cross section.

7. A rescue apparatus comprising a plurality of elongate, buoyant, rigid members, each of the members defining a sealed inner space, the sealed inner space defined by each member being separate and independent from the sealed inner space defined by each of the other members, the members being attached at their respective ends to one another at a selected one of a plurality of possible angles relative to one another and in a manner to prevent relative movement between the attached members, wherein all of the plurality of members are attached together so as to lie in the same plane.

8. The rescue apparatus of claim 7, wherein each of the members is provided with one or more rigidity-enhancing grooves extending along length thereof.

9. The rescue apparatus of claim 8, wherein the grooves are V-shaped in cross section.

10. A rescue apparatus comprising a plurality of elongate, buoyant, rigid members attached at their respective ends to one another at a selected one of a plurality of possible angles relative to one another and in a manner to prevent relative movement between the attached members, an end of each of the members having one or more projections for selectively mating with one or more complementary indentations on an end of the member attached thereto, further comprising a sleeve of foamed material fitted over one or more of the members.

11. The rescue apparatus of claim 10, wherein the members are hollow.

12. The rescue apparatus of claim 10, wherein all of the plurality of members are attached together so as to lie in the same plane.

13. The rescue apparatus of claim 10, wherein each of the members is provided with one or more rigidity-enhancing grooves extending along length thereof.

14. The rescue apparatus of claim 13, wherein the grooves are V-shaped in cross section.

* * * * *